United States Patent [19]

Gustavsson et al.

[11] Patent Number: 4,483,049

[45] Date of Patent: Nov. 20, 1984

[54] THEFT-DETERRENT DEVICE

[76] Inventors: Bo O. Gustavsson, Gökvägen 9, S-141 72 Huddinge; Kerstin E. Gustavsson, Väpnarvägen 40, 145 72 Norsborg; Inger A. Andersson, Majgårdsvägen 5, 141 44 Huddinge, all of Sweden

[21] Appl. No.: 249,232

[22] Filed: Mar. 30, 1981

[30] Foreign Application Priority Data

Apr. 10, 1980 [SE] Sweden ..... 8002757

[51] Int. Cl.[3] ..... A44B 9/18

[52] U.S. Cl. ..... 24/160; 24/150 R; 222/82; 222/175

[58] Field of Search ..... 24/150 R, 155 BR, 155 DR, 24/160, 110, 211 L, 150 FP; 222/175, 78, 82, 39, 175

[56] References Cited

U.S. PATENT DOCUMENTS

| | | | |
|---|---|---|---|
| 2,625,725 | 1/1953 | Sampson | 24/160 |
| 2,833,014 | 5/1958 | Graham | 24/160 |
| 3,911,534 | 10/1975 | Martens et al. | 24/150 R |
| 4,058,237 | 11/1977 | Luke | 222/175 |
| 4,104,622 | 8/1978 | Van Niel | 24/150 R |
| 4,221,025 | 9/1980 | Martens et al. | 24/155 BR |
| 4,241,850 | 12/1980 | Speer | 222/82 |
| 4,308,976 | 1/1982 | Speer et al. | 222/175 |

*Primary Examiner*—Gene Mancene
*Assistant Examiner*—Kris R. Schulze
*Attorney, Agent, or Firm*—Browdy and Neimark

[57] ABSTRACT

The invention relates to a theft deterrent device which can be lockably fastened to an article (4) made of cloth, leather, skin or like material, in a manner such that it can only be removed from the article with the aid of special means intended therefor. The device is, to advantage, in the form of a clamp which can be closed around an edge part of the article and therewith automatically locked in position. Arranged in the two halves of the clamp-like device are steel pins which penetrate the material from which the article is made, so that the device sits firmly thereon. The device includes one or more enclosed spaces, preferably in the form of glass ampoules (19) arranged in cavities (15) in the device. The ampoules contain a heavily staining and/or ill-smelling substance, for example a gas or liquid under pressure, and are arranged to break readily if an attempt is made to remove the device by force. When the ampoules break, the substance streams onto the article in question, causing it to become heavily stained and/or impregnated with an obnoxious odor, thereby rendering the article unusable.

12 Claims, 6 Drawing Figures

THEFT-DETERRENT DEVICE

The present invention relates to a device which can be attached to an article offered for sale in a shop, store or like business, in a manner such that said device can only be removed from the article by authorized personnel with the aid of special means designed for such purpose, and which is intended to act as a deterrent against theft.

The loss of goods through theft is a serious problem within the retail business. This is particularly true of clothing and like goods, which can be taken into a fitting room by a customer, be put on or simply placed into a bag or like holder and subsequently removed from the store without the personnel noticing. Department stores and shops have attempted to protect themselves against theft with the use of various kinds of technical aids, since the use of personnel employed especially for that purpose is expensive and not particularly effective. For example, it is known to provide each article offered for sale with an anti-theft alarm plate which is attached to said article and is provided with locking means so that it can only be removed by an authorized person at the pay-in point, with the aid of a special tool or device. The alarm plate includes an electronic unit, normally in the form of a resonance circuit, which causes an alarm signal to be given off should the alarm plate be carried past a detector device located at the store exit or, for example, at an exit from a restricted sales area in a large department store. The costs of obtaining and maintaining the fixed detector equipment in such an anti-theft system are relatively high, however. Moreover, the use of such a system limits the design of the sales floor, because each detector device must be located at each exit from said floor in a manner which is both effective and aesthetic. The functioning of such alarm systems is also relatively unreliable, and the systems are apt to give a false alarm. It has also been found a relatively simple manner to outwit anti-theft systems of the kind described, since the alarm plate can be electrically shielded with the aid of relatively simple means, so that no alarm is sounded when the plate is moved past the detector. The locking means used with known alarm plates are also unsatisfactory, since said plates can be readily removed from the goods with the aid of tools other than those intended. For example, the plates can be removed from the goods inside a fitting room in a manner such as not to damage the goods, whereafter said goods can be removed from the shop or store without notice.

The object of the invention is therefore to provide an improved anti-theft device which can be lockably attached to goods, such as primarily articles made of cloth, leather, skin and like materials, in a manner such that said device cannot be removed from the goods without the use of a special aid herefor, but which is not primarily intended to prevent the goods being removed unlawfully from the shop or sales floor etc., but to eliminate the incentive to such thefts.

To this end there is proposed a theft-deterrent device arranged to be fastened to an article made of cloth, skin, leather and like material and having locking means whereby said device can only be unfastened legitimately with the aid of special means intended therefor, and further having at least one closed space, which contains a heavily staining and/or a strongly ill-smelling substance capable of adhering permanently to the material from which the article is made, the walls defining said space being arranged to break when said device is subjected to undue force, thereby causing said substance to spread onto the article.

Since it is not possible to remove the device according to the invention from the goods unlawfully, without heavily staining and/or saturating the goods with the obnoxious smelling substance, therewith rendering the goods useless, the actual incentive to theft is removed. The use of theft deterrent devices according to the invention should therefore result in a far lower number of thefts than with the electronic anti-theft devices which are used hitherto and which can be unlawfully removed from the goods to which they are attached without seriously damaging said goods. The theft deterrent device according to the invention is also provided with a locking means which is an improvement on the electronic alarm plates used hitherto and which makes it much more difficult to remove a device according to the invention from goods unlawfully, particularly since even moderate damage to said device will cause the staining and/or obnoxious smelling substance to spread over the goods. The theft deterrent device according to the invention also affords the important advantage over previously known electronic anti-theft systems whereby no expensive, fixed detector equipment, requiring maintenance, need to be installed in the sales room.

An exemplary embodiment of a theft-deterrent device according to the invention will now be described with reference to the accompanying drawing, in which FIG. 1 is a plan view of a device attached to a sales article which is only partially shown;

Figure 6:
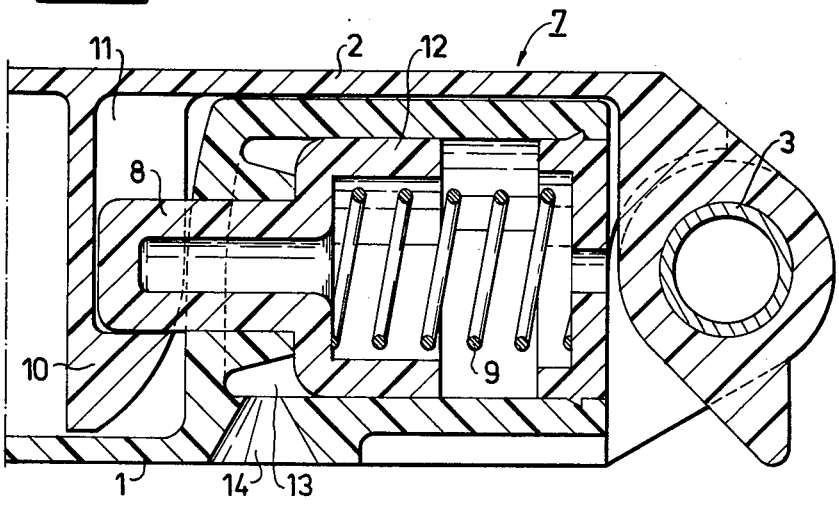
FIG. 6 is a sectional view, in larger scale, corresponding to FIG. 2 and taken through that part of the device which includes the locking means.

The exemplary and illustrated theft-deterrent device according to the invention comprises two substantially rectangular, flat, plate-like halves 1 and 2 which are arranged for rotation at respective one short side thereof about a common shaft 3, such that the device obtains substantially the form of a clamp with a hinge at one end. The clamp can be fastened to an edge portion of an article 4, for example an article made of cloth, skin, leather or like material, by fitting the clamp over said edge portion and closing the clamp. The device is fastened to the article 4 through the action of a plurality of steel pins 5 which are fixedly mounted on one half 1 of said device and which penetrate the material of the article 4 such that the points of said pins enter recesses 6 formed to this end in the other half 2 of said device. When the two halves 1 and 2 of the device have been brought together in this manner, the said halves are automatically locked in position by means of a locking arrangement shown generally at 7 and located in the vicinity of the hinge pin 3. As will best be seen from FIG. 6, the locking arrangement 7 comprises a locking element or bolt 8 arranged for axial movement in one half 1 of the device and acted on by a spring 9, and a locking hasp or hook 10 having a rearwardly lying recess 11, which is arranged in the other half 2 of said device and into which the locking bolt 8 snaps under the action of spring 9 as the two halves are closed together. When the device is closed, it cannot be opened unlawfully without using violance or causing external damage.

To enable the device to be removed from the article 4, as the customer pays for said article for example, the locking bolt 8 is provided on the rear side thereof with a plunger 12 which runs in a chamber 13 formed in the half 1. The chamber 13 communicates with the outside of the device through a passage 14, through which a pressure medium, preferably compressed air, can be introduced into the chamber 13, such that the plunger 12, and therewith the locking bolt 8, is urged rearwardly against the pressure of the spring 9, whereby the bolt moves out of engagement with the hook 10 so that the device can be opened and removed from the article 4. Thus, in order to be able to open the device and remove it from the article, access is required to a source of compressed air of sufficiently high pressure to force the locking bolt 8 back against the force of the spring 9. The spring 9 can, without difficulty, be made so strong that compressed-air sources of the requisite pressure are not found readily to hand. Further, it is an advantage if the mouth of the passage 14, on the outside of the device, is so formed that it will only fit a similarly formed connector nozzle on the compressed-air source.

Figure 1:
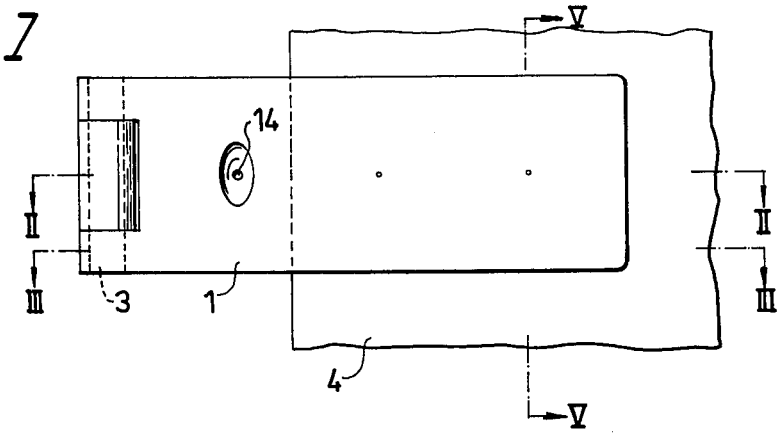
Figure 2:
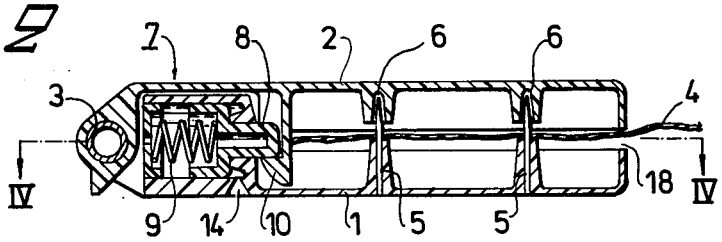
FIG. 2 is a sectional view of said device, taken on the line II—II in FIG. 1.
Figure 3:
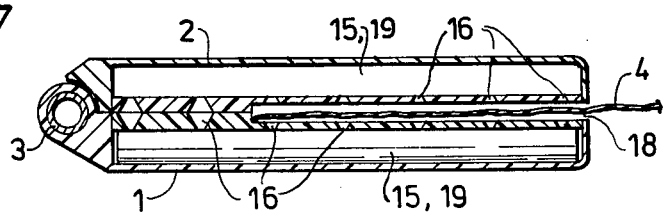
FIG. 3 is a sectional view of said device taken on the line III—III in FIG. 1.
Figure 4:
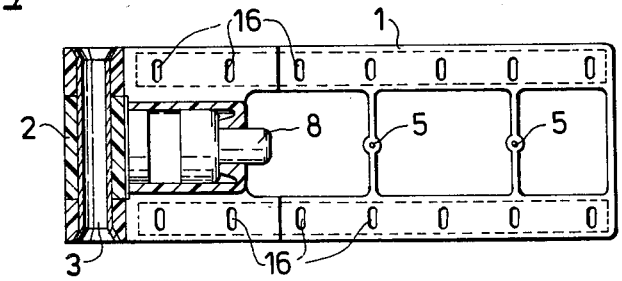
FIG. 4 is a sectional view of said device taken on the line IV—IV in FIG. 2.
Figure 5:
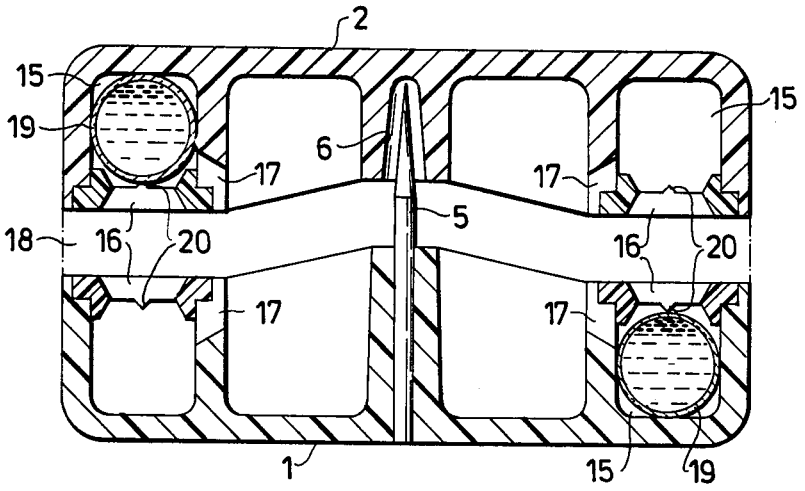
FIG. 5 is a sectional view of said device in larger scale, taken on the line V—V in FIG. 1.

As will best be seen from FIG. 5, each of the two halves 1 and 2 of the illustrated device according to the invention is provided with two elongate channels 15, each of which extends along a respective one of the two long sides of the device substantially along the whole length thereof. Each of the channels 15 has arranged therein a plurality of openings 16 and 17 directed towards the gap 18 present between the two halves 1 and 2 with the article 4 clamped therebetween. There can be placed in each of the channles 15 a glass ampoule 19. In the illustrated embodiment only two, diagonally opposite channels 15 have been provided with ampoules 19. The ampoules contain a heavily staining and/or ill-smelling substance, preferably a liquid or gas under pressure, which is able to adhere durably to the material of which the article 4 is made. If an unauthorized person attempts to remove the clamp-like device from said article 4 with the use of force or by causing external damage to said device, at least one of the ampoules 19 will break, causing said staining and/or ill-smelling substance to be sprayed out through openings 16 and 17 onto that part of the article 4 located in the gap 18, thereby rendering the article unusable. The two halves 1 and 2 of the device can, to advantage, be made of a strong but somewhat flexible plastics material, such as impact resistant polystyrene for example, so that the ampoules 19 will break when the device is subject to only a relatively small force. This can be further ensured by providing the channels 15 housing said ampoules with a plurality of outwardly projecting points or teeth 20 which lie against the outer surfaces of the ampoules 19 and give rise to a high contact pressure on the walls of said ampoules when the clamp-like device is subjected to external forces.

It will be observed that in the illustrated exemplary embodiment of the theft deterrent device according to the invention, the locking arrangement 7 which holds the clamp-like device closed, is separate from the pins 5 which hold said device firmly to the article 4. In the previously known electronic alarm plates, the locking arrangement is generally arranged to co-operate with the ends of the metal pins passing through the article to which the plates are attached, and hence in the case of the known plates it is a relatively simple matter to force the plates apart. In the case of the theft deterrent device according to the invention, however, the steel pins 5 cannot be reached from the outside when the device is attached to the article 4, and hence it is impossible to remove said device by attempting to force the pins. In order to render it impossible to insert a saw blade in the gap 18 between the two halves 1 and 2 of the device and saw off the pins, the mutually opposing surfaces of the halves 1 and 2 defining said gap are so formed that the gap extends in a plurality of mutually deviating planes. In order to make it still more difficult to saw off the hook 10, which is of plastic material, by inserting a saw blade or a similar tool in the gap 18, one of the steel pins 5 can, to advantage, be placed in front of the hook 10, relatively close to the same.

It will be understood that the invention is not restricted to the described and illustrated embodiment of a theft-deterrent device, but that other embodiments and modifications lying within the scope of the claims are conceivable. The essential feature of the invention, however, is that the device has at least one closed space which contains a heavily staining and/or highly smelling substance, and the walls of which are so formed that they will readily break when the device is subjected to external forces, causing said substance to stream out onto the article to which the device is attached and render said article unusable.

We claim:

1. A device for discouraging theft on an article displayed for sale, which article is made of cloth, skin, leather or like materials, comprising means for attaching the device externally to said article, locking means for locking the device in said attached state in a manner preventing unauthorized disattachment of the device from the article, at least one closed space located within the device, a substance held in said closed space, said substance having the properties of adhering permanently to the material of said article, when brought in contact therewith, and rendering the article unfit for its intended use, and said closed space having at least one confining wall designed to be easily breakable when the device is subjected to undue external forces as a result of an attempt of unauthorized disattachment of the device from said article, whereby said substance is released to spread onto said article and to render it unfit for its intended use, comprising a first member and a second member having mutually facing surfaces and being movable relative each other between an open position and a closed position, a part of said article being inserted and captured between said mutually facing surfaces in said closed position, said fastening means including metal pins fixedly mounted in said first member projecting outwardly from said surface of said first member towards said surface of said second member and corresponding recesses in said surface of said second member for receiving said metal pins when said first and second members are in said closed positions, and said locking means including mutually co-acting locking elements located in said first and second members, respectively, and separated from said pins for locking said first and second members in said closed position.

2. A device as claimed in claim 1, wherein said locking means includes an axially displaceable spring-biased locking bolt in one of said first and second members and a recess in the other of said members, into which recess said locking bolt snaps when said first and second members are in said closed position.

3. A device as claimed in claim 2, wherein said locking bolt has the form of a plunger axially movable within a chamber provided in said one member, and a passage extending within said one member between said chamber and the outside of the member, whereby a pressurized medium can be introduced through said passage into said chamber for moving said locking bolt out of engagement with said recess against the spring-biasing of the locking bolt.

4. A device as claimed in claim 1, comprising hinge means connecting one end of said first member to one end of second member.

5. A device as claimed in claim 1, wherein said first and second members have substantially the form of rectangular plates having channels extending along the long side edges of the plates substantially over the entire length of the plates, one or more glass ampoules containing said substance being mounted in said channels.

6. A device as claimed in claim 1, wherein said mutually facing surfaces of said first and second members have mutually interfitting non-planar contours such that the interspace between said surface, when said first and second members are in said closed position, extends in a plurality of mutally deviating planes.

7. A device as claimed in claim 1, wherein said substance is a staining substance.

8. A device as claimed in claim 1, wherein said substance is an ill-smelling substance.

9. A device as claimed in claim 1, wherein said substance is a liquid.

10. A device as claimed in claim 1 wherein said substance is gaseous.

11. A device as claimed in claim 1, wherein said closed space comprises a sealed glass ampoule which contains said substance and is disposed in a cavity formed within the device, said cavity including walls having openings permitting said substances to escape onto said article upon rupture of said glass ampoule.

12. A device as claimed in claim 1, wherein said walls comprise projecting portions extending toward said glass ampoule to exert a rupturing pressure on the ampoule when the device is subjected to undue external forces.

* * * * *